US005639124A

United States Patent [19]

Jung

[11] Patent Number: 5,639,124

[45] Date of Patent: Jun. 17, 1997

[54] TAB ARRANGEMENT

[75] Inventor: Jürgen Jung, Neunkirchen, Germany

[73] Assignee: Mappei-Organisationsmittel GmbH, Wuppertal, Germany

[21] Appl. No.: 537,900

[22] PCT Filed: Dec. 23, 1994

[86] PCT No.: PCT/EP94/04303

§ 371 Date: Oct. 24, 1995

§ 102(e) Date: Oct. 24, 1995

[87] PCT Pub. No.: WO95/23069

PCT Pub. Date: Aug. 31, 1995

[30] Foreign Application Priority Data

Feb. 28, 1994 [DE] Germany ..... 44 06 430.6

[51] Int. Cl.[6] ..... B42F 13/00

[52] U.S. Cl. ..... 283/36; 283/37; 40/359

[58] Field of Search ..... 283/36, 37, 38, 283/39, 40, 41, 42; 493/947; 40/359; 281/38, 42

[56] References Cited

U.S. PATENT DOCUMENTS

| | | | |
|---|---|---|---|
| 2,878,814 | 3/1959 | Consaul | 40/359 |
| 3,805,426 | 4/1974 | Cunningham | 283/39 X |
| 4,184,699 | 1/1980 | Lowe . | |
| 4,477,013 | 10/1984 | Herrin | 40/359 X |
| 5,187,888 | 2/1993 | O'Brien et al. | 40/359 |
| 5,341,982 | 8/1994 | Syers | 40/359 X |

FOREIGN PATENT DOCUMENTS

| | | |
|---|---|---|
| 0328751 | 8/1989 | European Pat. Off. . |
| 1205432 | 2/1960 | France . |
| 853899 | 2/1952 | Germany . |
| 1890232 | 4/1964 | Germany . |
| 1461380 | 12/1968 | Germany . |
| 2416247 | 10/1975 | Germany . |
| 2803385 | 8/1979 | Germany . |

*Primary Examiner*—Willmon Fridie, Jr.
*Attorney, Agent, or Firm*—Martin A. Farber

[57] ABSTRACT

The invention concerns an array of tabs (3) projecting out beyond the edge (1) of the main surface (2) of files, card-index cards, etc., particularly tabs designed for written annotations. In order to provide variable-design tabs (3) which do not involve the loss of material, the invention proposes that the tab (3) is folded over to bring it out of the main surface area (2) of the file or card to expose an area down to the fold line (11).

8 Claims, 13 Drawing Sheets

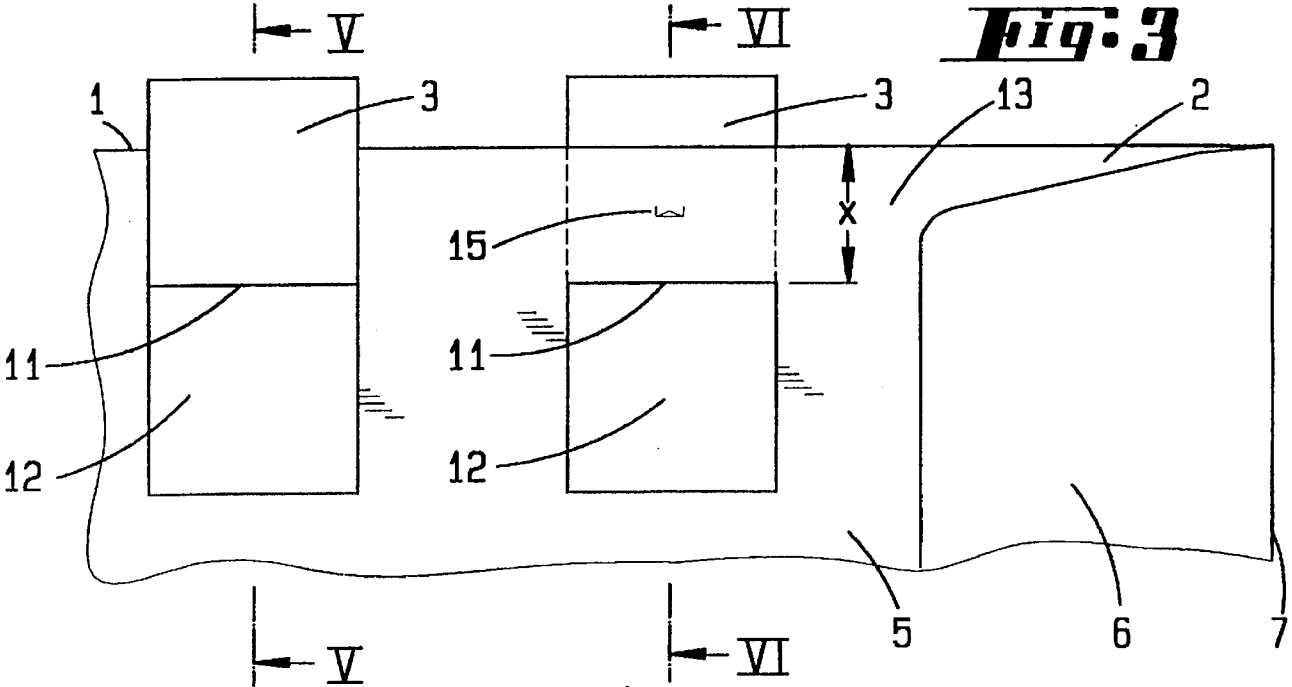
Fig. 3
2
7
6
13
5
3
x
VI
VI
15
11
12
3
V
V
1
11
12
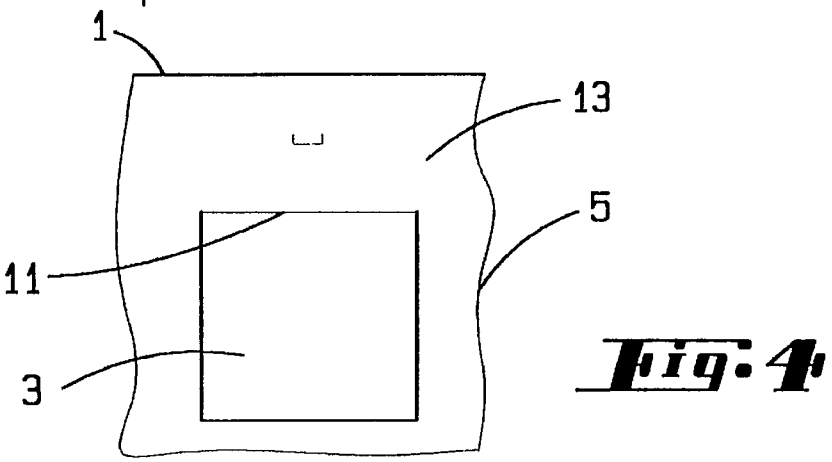
Fig. 4
13
5
1
11
3
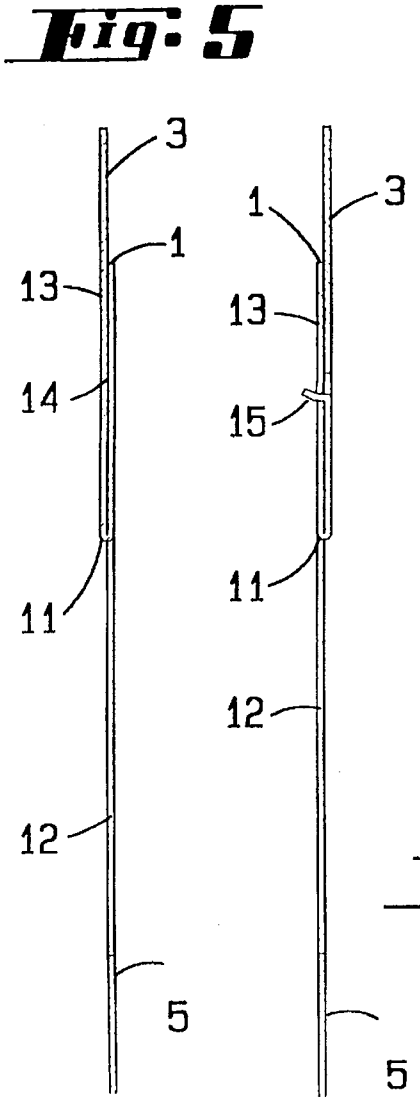
Fig. 5
3
1
13
14
11
12
5
Fig. 6
3
1
13
15
11
12
5

XXI
XXI
1
2
3
5
11
12
13
16
17'
19
20
20 (18)
21
22
X 25
23
28
29
25
26
27
30
5
4
25
27
26
11
3
2
1
9
8
31
30

TAB ARRANGEMENT

FIELD AND BACKGROUND OF THE INVENTION

The invention relates to an arrangement of tabs projecting over the edge of the base sheet of record folders, index cards or the like, in particular for inscription.

The conventional arrangement is a label or tag type tab with use of a self-adhesive layer on the tab for variable attachment (EP-1,461,380).

From DE-UM-1,890,232, there is known a guide or index card on the upper edge of which a tab continues in unitary manner from the main surface of the card. The tab is covered over at the front by a window panel, which leaves at the side a slide-in slit for a carrier for an inscription marking. This card is not however variable from the tab point of view.

From DE-PS-853,899 there emerges by contrast again in this connection a variable solution. Here however, the lateral field of the selected tab must be separated, even to achieve the marking projection of this tab. The tab forming sheet division is achieved by appropriate perforation.

From FR-PS-1,205,432, there exists the proposal to indent the edge of an assembly of sheets over the entire block thickness of the stack of paper and to provide the sheet of the stack to be identified with a glued label crossing the indentation.

Finally, it is known to form record folders from a multi-layered endless web perforated on its edges (see DE-OS-2, 416,247).

SUMMARY OF THE INVENTION

It is an object of the invention to form variable tabs for record folders in a more convenient manner, and in particular in a manner which is free of loss.

As a result of such an arrangement, there is achieved on a record folder or the like according to the invention a more advantageous tab arrangement. The arrangement is unitary, and integral as to material. In practical terms, it is provided that the tab which is releasable up to a fold-over line is capable of being folded over out of the area of the base sheet into the disposition in which it projects over the edge. The corresponding cutout in the body of the folder is acceptable without difficulty. Since as a rule, the rear wall of the record folder is used for this purpose, there is no loss of any surface capable of being written on, as this is mostly provided by the front wall. It is further of advantage that the tab to be folded over is one of a plurality of tabs, each of which is individually releasable and individually capable of being folded over. There is enabled use of a tab display which is optimal for review or also allows "cancellation", this being effected simply by folding back the tab. The breaking-out achieved by the release and folding out of the tab has further advantages in that the folded-over tab leaves behind a window in the base sheet. Without having to unfold the record folder, the user may establish whether the folder contains file material. In specific cases, it may also be further advantageous for the folded-out tab to be fixed in the disposition in which it projects beyond the edge. As well as a basically reversible securing, which allows return of the tab into its hidden position at any time, an irreversible arrangement may also be employed as required. To this end, the invention proposes that the fixing to the wide surface of an edge strip (edge zone) of the sheet is achieved by gluing, retaining toothing or the like, the edge strip being located between the edge over which the tab projects and the window. The aforementioned edge strip is then suitably of a width such that despite the windowing, stable holding together of the portion of the record folder or the like in the vicinity of the edge remains assured, along with good support for the tab. Particularly advantageous securing of the tab without any kind of additional means consists therefore in the fixing of a tab being effected by penetration through a slit in the edge strip. The folding-out movement which is used in any case is thus further used to carry out a kind of "through threading movement". An advantageous variant in a practical double-layered tab construction consists in the projecting region of the tab being achieved by folding over or folding back of the cut-free section about an upper edge of the tab and the free end of the fold-over section being fixed as a result of its penetrating through the slit of the edge strip (edge zone). The tab thus forms its own insertion pocket within the sheet. If windowing of the record folder itself is to be avoided, there exists an advantageous variant in which the releasable tabs are sections of a supplementary strip fixedly connected to the sheet. This indirect tab arrangement also brings stiffening of the folder wall. It has been shown to be further favourable for the supplementary strip to be realised as an adhesive strip associated with an endless web, the adhesive strip being provided with perforation holes aligned with the endless web. Finally, it has been shown to be favourable for achieving easier "through threading" of the tab through the slit for the side edges of the tab to be stepped with respect to one another or to extend in a converging manner and for the length of the push-through slit to correspond approximately to the length of the upper tab edge. This leads to a tapering positively supported disposition of the tab with respect to the sheet, the tab being also thereby aligned with the plane of the sheet, while it may alternatively also be provided for the length of the penetration slit to be less than the length of the fold-over edge and greater than the length of the upper tab edge.

BRIEF DESCRIPTION OF THE DRAWINGS

FIG. 3 shows an enlarged extract from FIG. 1, showing the rear wall of the record folder with selective front or rearward folding over of the tab, secured, FIG. 4 shows the part which is capable of being secured when the tab is still in its initial position, FIG. 5 shows the section on the line V—V of FIG. 3, with a tab secured by gluing, FIG. 6 shows the section on the line VI—VI of FIG. 3, a retaining toothing used as fixing means being shown.

DETAILED DESCRIPTION OF THE PREFERRED EMBODIMENTS

Figure 1:
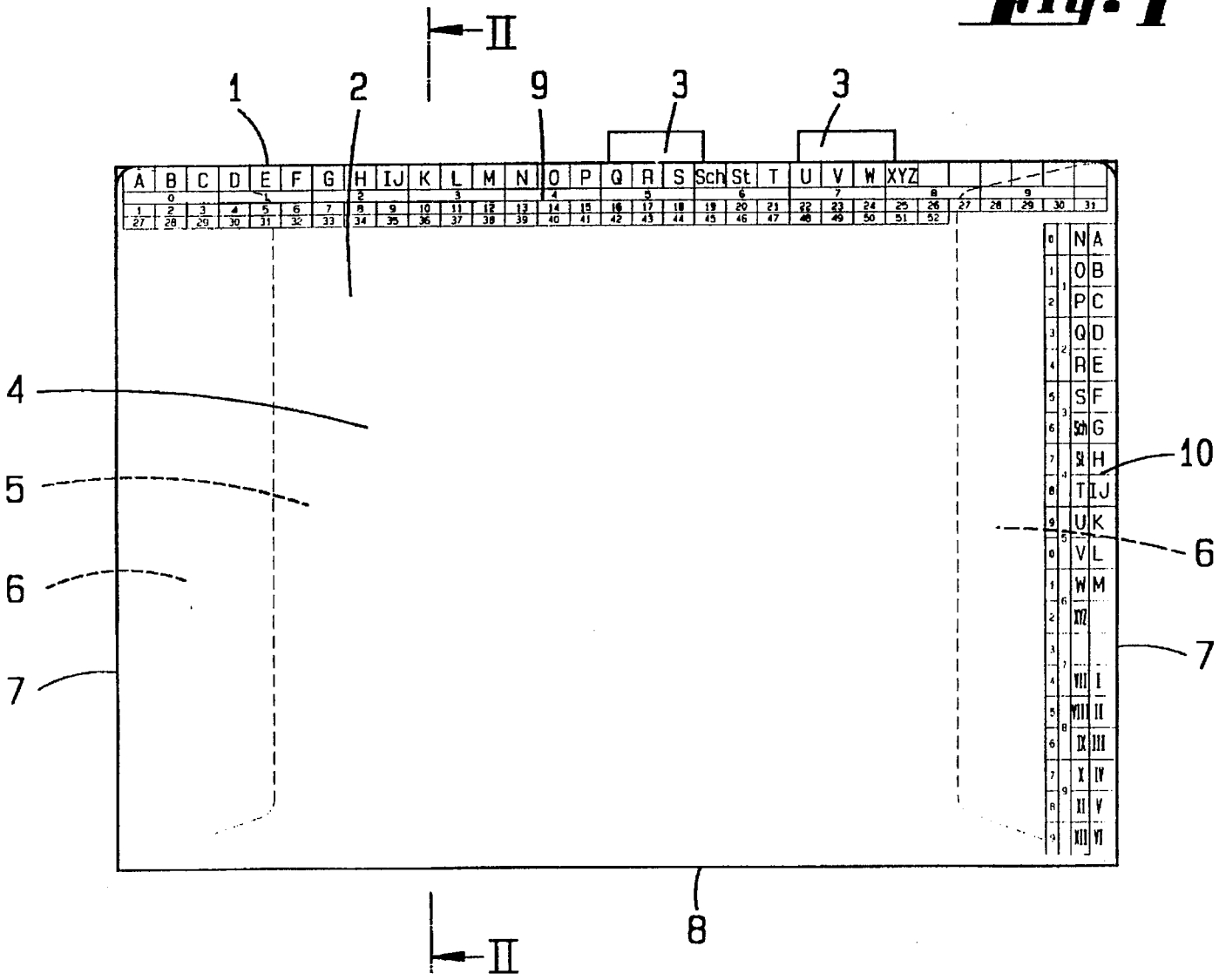
FIG. 1 shows a record folder formed according to the invention in accordance with a first embodiment, in front view, with folded out tabs.
Figure 2:
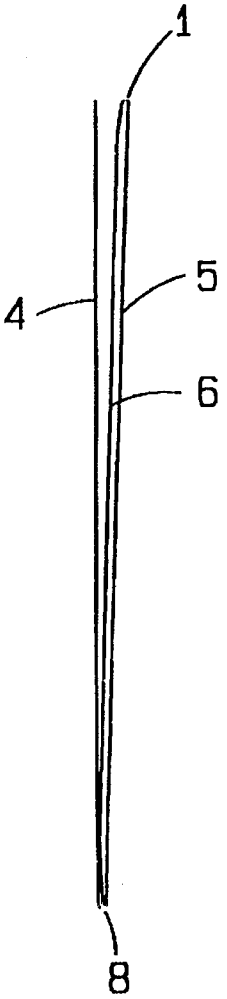
FIG. 2 shows the section on the line II—II of FIG. 1.

The record folders shown in the drawings consist of a folded blank, a folded blank to which there is added a supplementary strip or a folded blank formed from multilayer endless webs, one of which then functions as a supplementary strip which is disposed close to the edge and is suitably narrower.

Common to all embodiments and variants is the arrangement of tabs 3 projecting over the edge 1 of the basic sheet 2 of the record folders or files.

Figure 30:
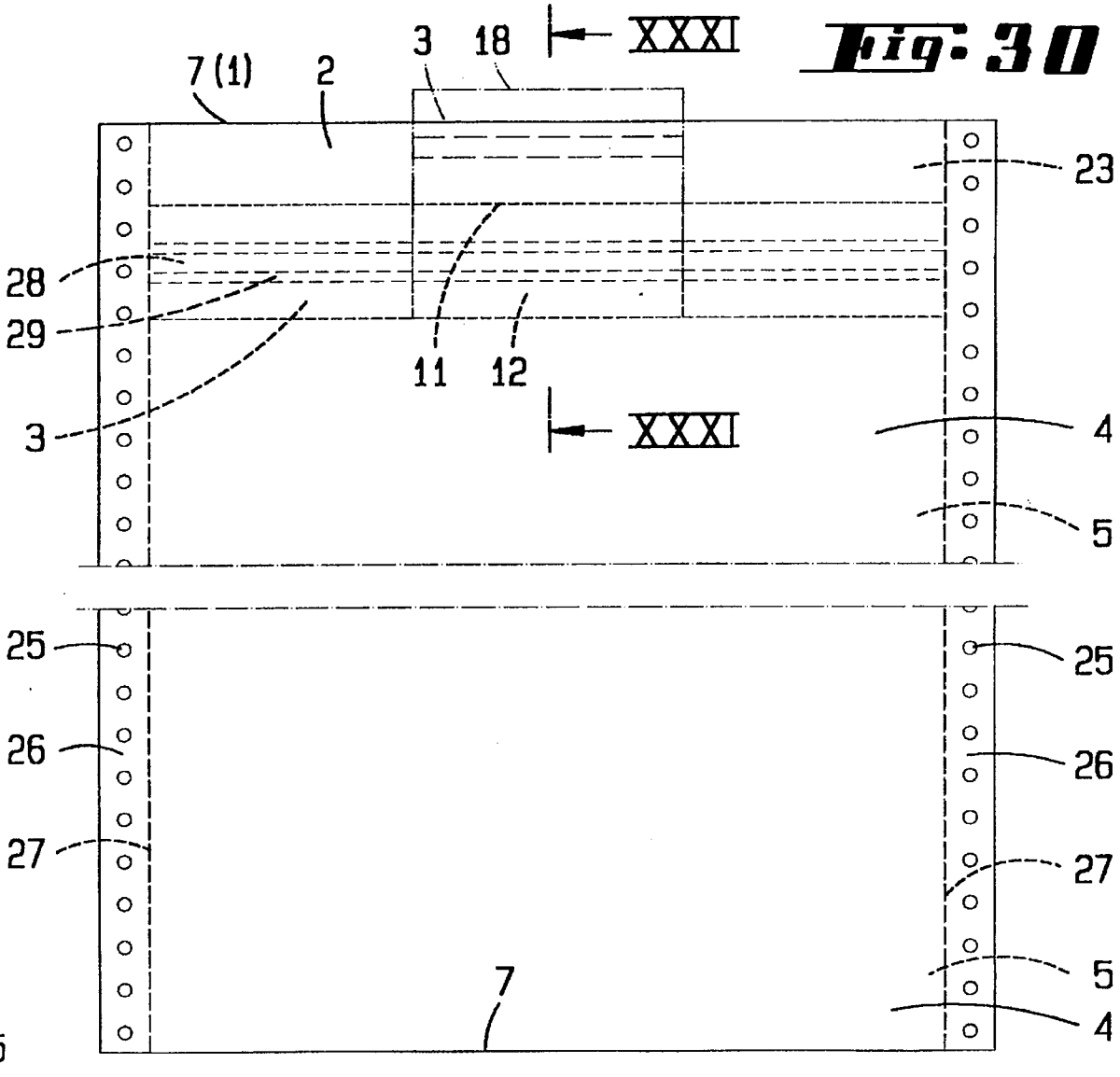
FIG. 30 is a variant of the fifth embodiment with representation of a supplementary strip disposed transversely to the extent of a peripheral perforation hole strip, engaged intermediately.
Figure 31:
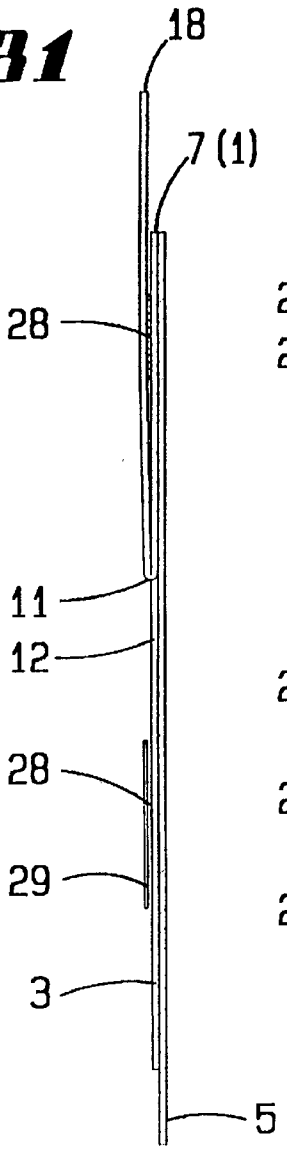
FIG. 31 is the section on line XXXI—XXXI of FIG. 30.

The tabs 3 may be flipped over from a normal position away from the edge through approximately 180° into the position shown, in which they clearly project over the edge. In regard to the edge 1 over which the tabs project, this is the upper edge of the record or file folder, although FIG. 30 shows a modification from this according to which the tab 3 projects over the left (and/or also the right) narrow side of the record folder.

The sheet 2 is defined by the large area wall of the record folder. In all embodiments, both walls, i.e. the front wall 4 and the rear wall 5, are practically equal in area.

The record folder is of rectangular shape. Foldable side flaps 6 extend from its rear wall 5 into the folded joints between front wall 4 and rear wall 5. Each lateral edge 7 forms fold lines for these flaps. A longitudinal edge 8 on the lower side provides the corresponding fold line between front wall 4 and rear wall 5.

Below the upper edge i and alongside the righthand lateral edge 7, there are printed scales 9, 10 on the front wall 4. The fields of these scales contain letters in alphabetical order and numerically ascending series of numbers. The ability to review a record system of this kind may thus be improved, in that for example not only is the initial indicated in the field of the scale, but in addition, the full name may also be entered in the viewing field of the tab 3. The tabs 3 etc. comprise therefore material capable of being written on.

As may be understood from the drawings, the tab 3 which is cut free up to a fold-over edge 11 is may be folded over in a projecting manner out of the plane of the sheet 2 about this edge, which forms a hinge, into the disposition in which it projects beyond the edge. The folding over may take place in such a manner that the tab 3 is supportingly engaged against the front side of the rear wall 5 or against the rear side of the rear wall 5. For this support, there is available a good two-thirds of the length of the tab 3 measured in the foldout plane or direction. The supported parallel arrangement clearly results from the associated cuts. The fold-over edge 11 extends parallel to the edge 1.

The individual tabs 3 may be released from the three-sided cut free region and/or perforation region independently of one another and folded over into the disposition shown in which they are ready to fulfill their function. A window 12 resulting from this leaves the possibility of looking through at the folder-forming cutout or the like in the case of integral formation of the tab 3, without having to open the record folder. The user may establish whether the usual type of documents are in the file folder appropriate for the documents in question. The window 12 is located in the rear wall 5 of the record folder at a sufficient spacing from the edge for the stability of the folder not to be adversely affected.

The folded over tab 3 is fixable in its disposition projecting over the edge. As a basis for this fixing, there remains a sufficiently wide edge strip 13 available, on account of the significant spacing of the fold-over edge 11. The width x of the edge strip corresponds to the two-thirds ratio mentioned for the length of the tab 3 measured in the folding direction, one-third of the length remaining for the projection.

Fixing may be by adhesive (FIG. 5). The adhesive layer, for example, glue or self-adhesive, is indicated by the reference numeral 14.

If by contrast a reversible connection is provided, there may be in question a retaining layer of the repositionable kind.

Securing of the tab in its folded out position may also be achieved without any additional means whatever by further use for this purpose of the cutout itself, in which arrangement this cutout has a retaining toothed portion 15 likewise achieved by cutting free, an arrangement which is for example known for securing the edges of newspapers beneath one another. This toothed portion engages both the material of the portion of the tab 3 which is cut free and also the material of the side surface of the edge strip 13. In the latter case, there is in question a U-shaped cutout and in the first case, a V-shaped cutout, which leads to a kind of staple-form through engagement, as it is shown in FIG. 6. The retaining toothing 15 is located halfway between the edge I over which the tab projects and the edge 11 of the window 12 which is disposed nearest to this edge 1, that is to say, fold-over edge 11.

Figure 7:
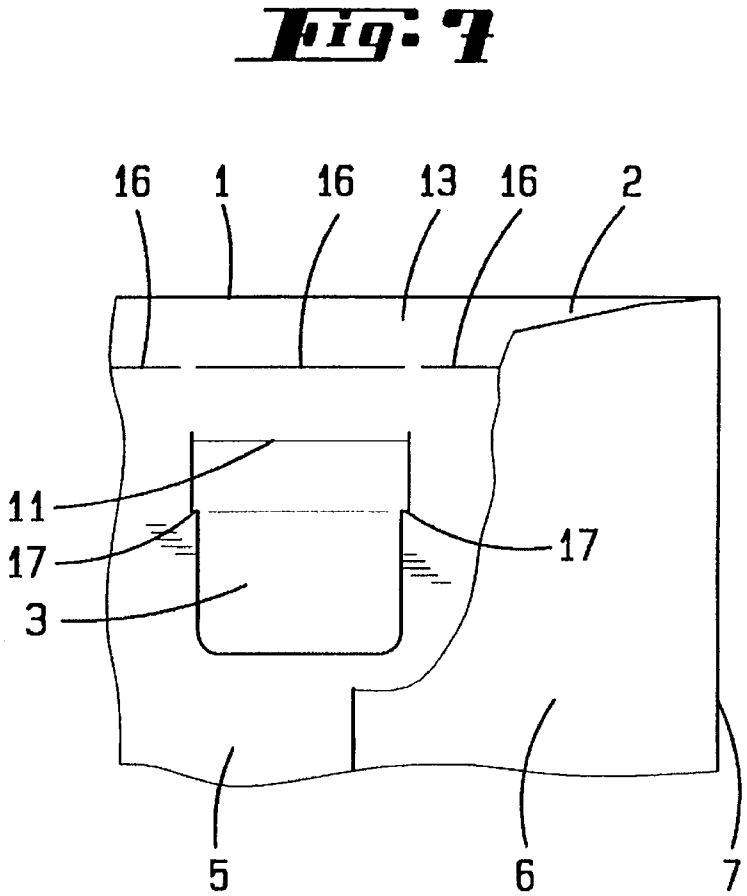
FIG. 7 shows a section of a record folder according to a second embodiment using fixing of the tab by means of a push-through slit, the tab being in its initial position and the side edges of the tab being stepped.
Figure 8:
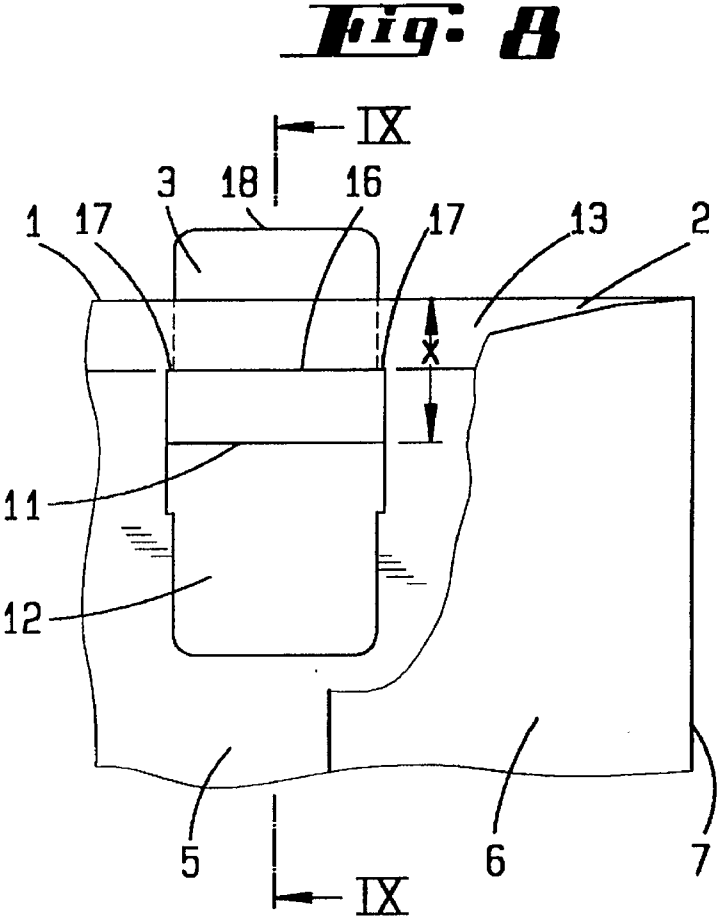
FIG. 8 shows the same tab brought over into its position of use.
Figure 9:
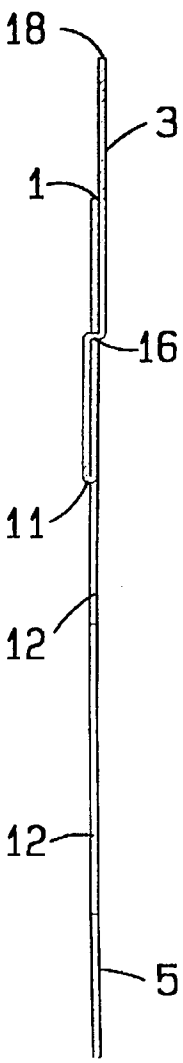
FIG. 9 shows a section on the, line IX—IX of FIG. 8.

The securing of the tab 3 in the plane of the sheet 2 is however optimised by the tab 3 being brought through a push-through slit 16 in the edge strip 13. This version of the arrangement is apparent from the second embodiment (FIG. 7). The push-through slit 16 extends parallel to the fold-over edge 11 and is located approximately midway between the edge 1 and the fold-over edge 11. The push-through direction, which extends outwardly, uses the path to the front side of the rear wall, as this is shown in FIGS. 7 to 9. It is to be understood that the path by way of the rear side may also be taken (not shown).

In order to be able to bring the free end of the portion forming the tab through the above-mentioned slit 16 in a convenient manner, the free end is formed to be somewhat narrower up to the one-third of the length of the tab at the fold-over edge end. In addition, the free corner regions of the shape forming this portion are rounded in a convex manner. The partial narrowing of the tab 3 relates only to a region of the length which lies on the far side of the slit plane 16. The change in width is clearly apparent from FIG. 7. There are in question therefore shoulders 17 of equal height, which are supported on the slit ends of the push-through slit 16, these remaining closed and thus protecting the fold-over edge 11 and therefore the sensitive hinge region. There is therefore no question of easy tearing of the base or root of the tab, even if the tab is pulled to some extent. The complementary shape to the shoulders 17 results in like manner in the contour of the cutout window 12 in FIG. 8.

Figure 10:
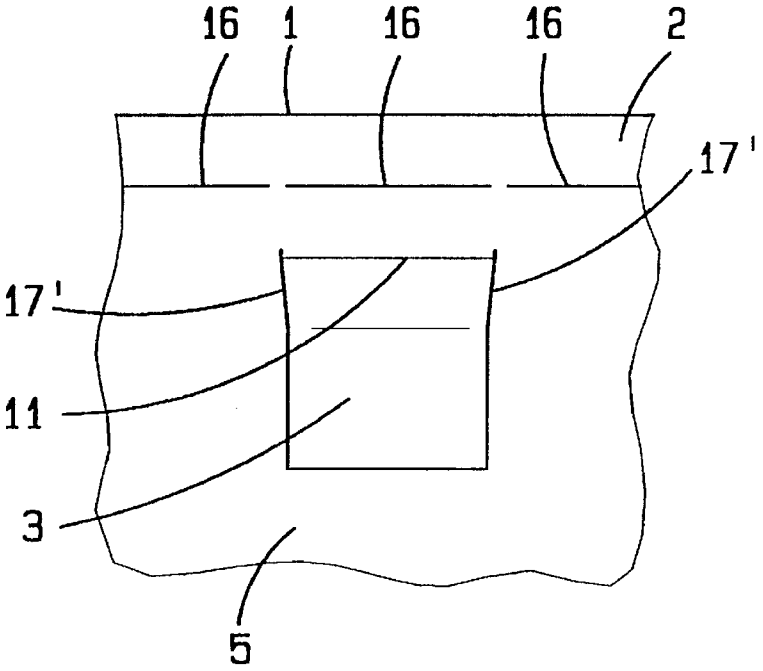
FIG. 10 shows a first variant of the second embodiment in the initial position, with representation of a tab having converging side edges in its initial position.
Figure 11:
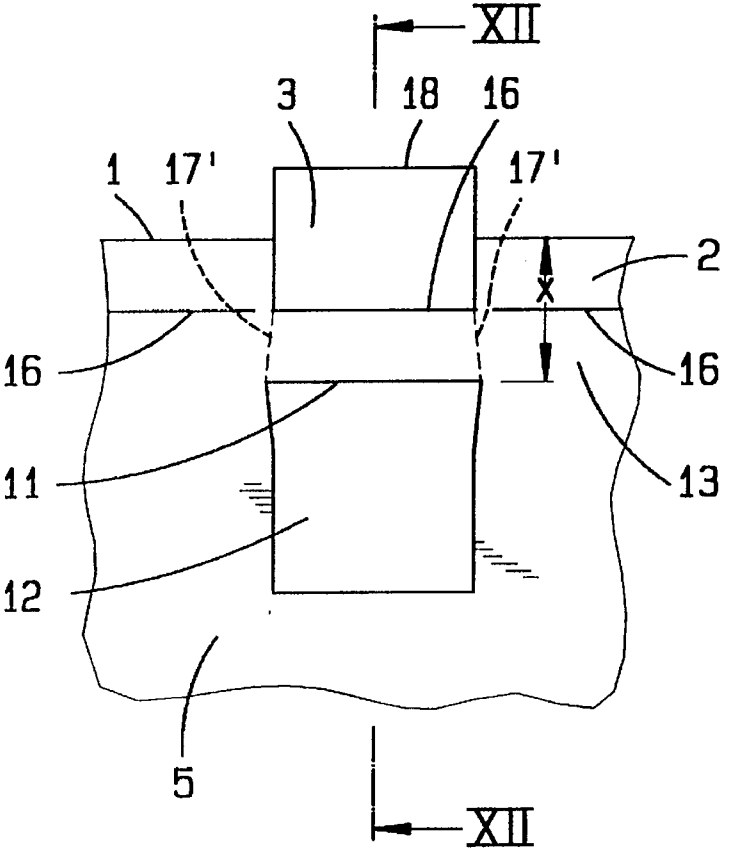
FIG. 11 shows the same brought into its position of use, with push-through of the tab on the rear side.
Figure 12:
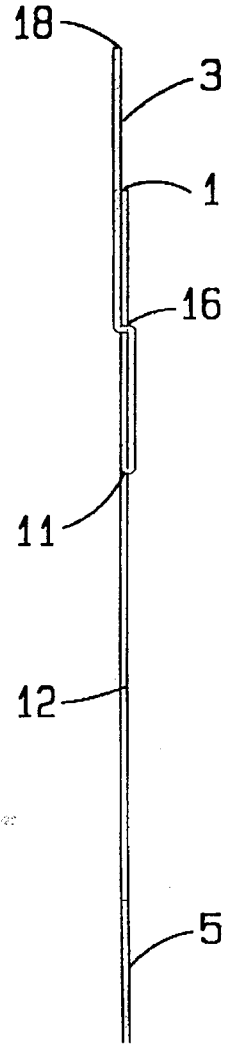
FIG. 12 shows a section on the line XII—XII of FIG. 11.
Figure 13:
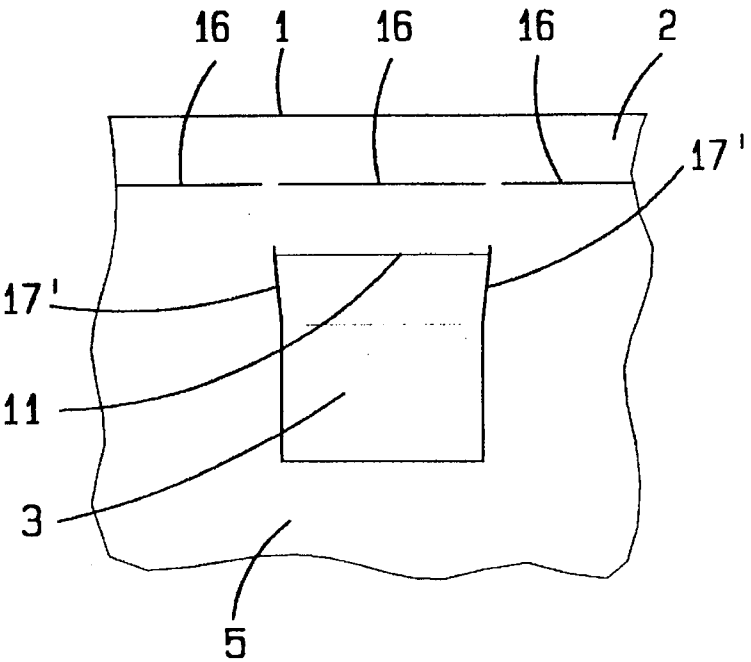
FIG. 13 shows a second variant of the second embodiment, in a representation corresponding to FIG. 10.

The variants of the two embodiments shown in FIG. 10 incorporate a development to the extent that the side edges of the tab 3 in the region of the fold-over edge 11 extend in a converging manner in the outward direction, so that they taper towards one another over the length of the push-through slit 16. The convergence is located on the section between fold-over line 11 and the push-through slit 16. From there on, there is again present the usual parallel edge boundary of the tab 3. The length of this push-through slit 16 corresponds substantially to the length of the upper edge 18 in the region of the free end of the tab 3. That leads here also to a welcome positional security for the entering tab with greatly eased insertion of the free end. The step achieved in this case by the converging course of a section of the two side edges is designated by reference 17'.

An advantageous embodiment in the sense of a cooperating securing of the tab 3 may be further achieved by the side edges of the tab 3 extending not merely in a converging manner, but by the length of the push-through slit 16 being less than the length of the fold-over edge 11, but greater than the length of the upper tab edge 18. In this manner, the initial portions of the side edges may cut somewhat into the slit ends of the push-through slit 16 in the case of a sufficiently long sloping stage 17'. There results a more V-shaped arrangement. In this case, the above-mentioned rounding of the tab ends (not shown) may be similarly useful.

Figure 14:
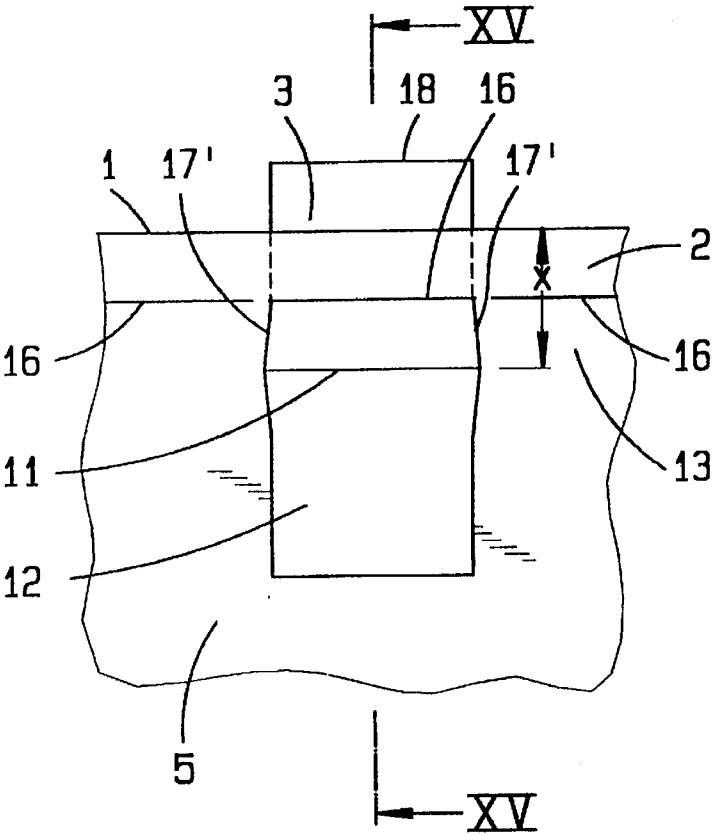
FIG. 14 shows the same in a representation corresponding to FIG. 11, but with pushing through of the tab through the push-through slit, on the front side.
Figure 15:
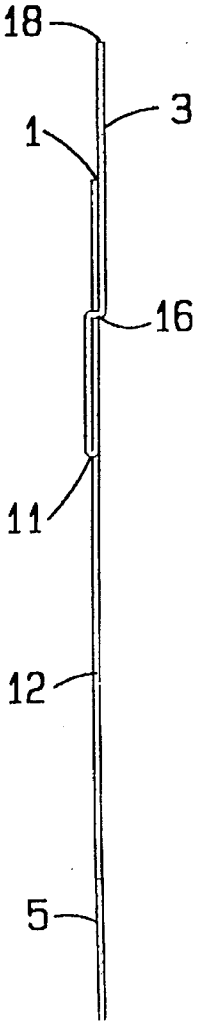
FIG. 15 shows the section on the line XV—XV of FIG. 14.

These variants show not only the insertion of the material portion forming the tab 3 proceeding from the rear side of the rear wall 5, but also in FIG. 14, the insertion of same proceeding from the front side of the rear wall 5.

Figure 16:
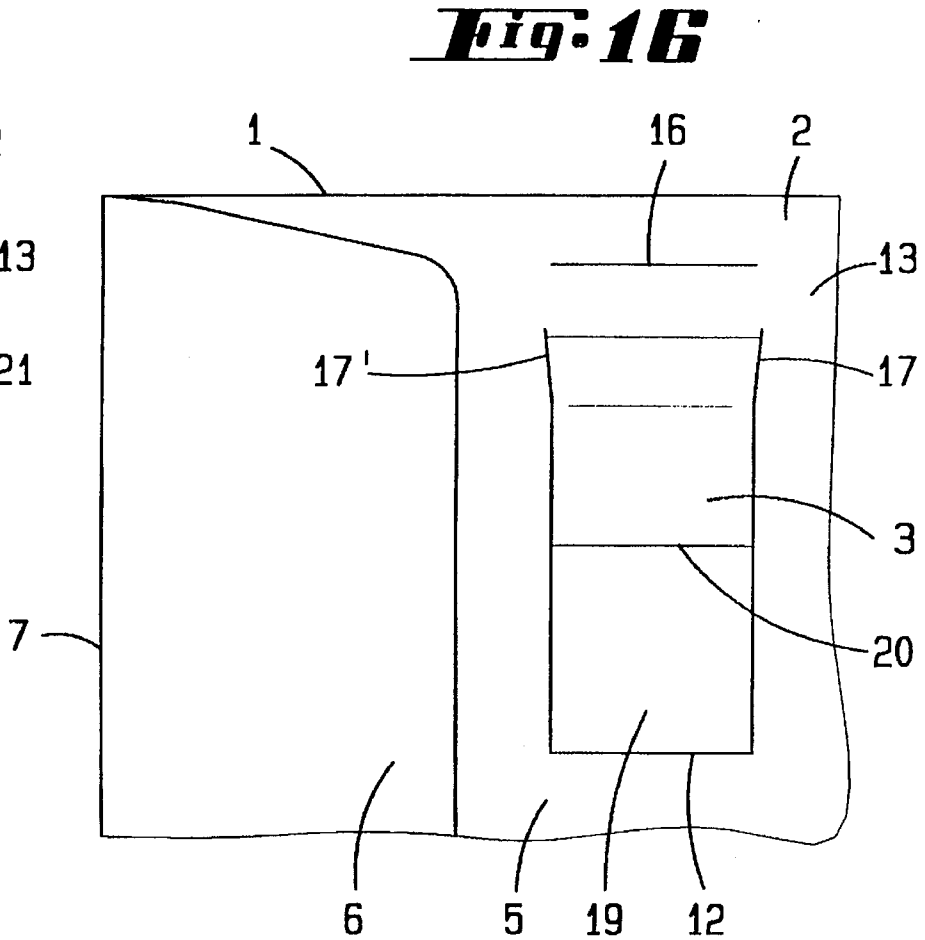
FIG. 16 shows the record folder formed according to the invention according to a third embodiment, in partial front view and with the tab in its initial disposition, the tab being approximately twice the length of the previous tab.
Figure 17:
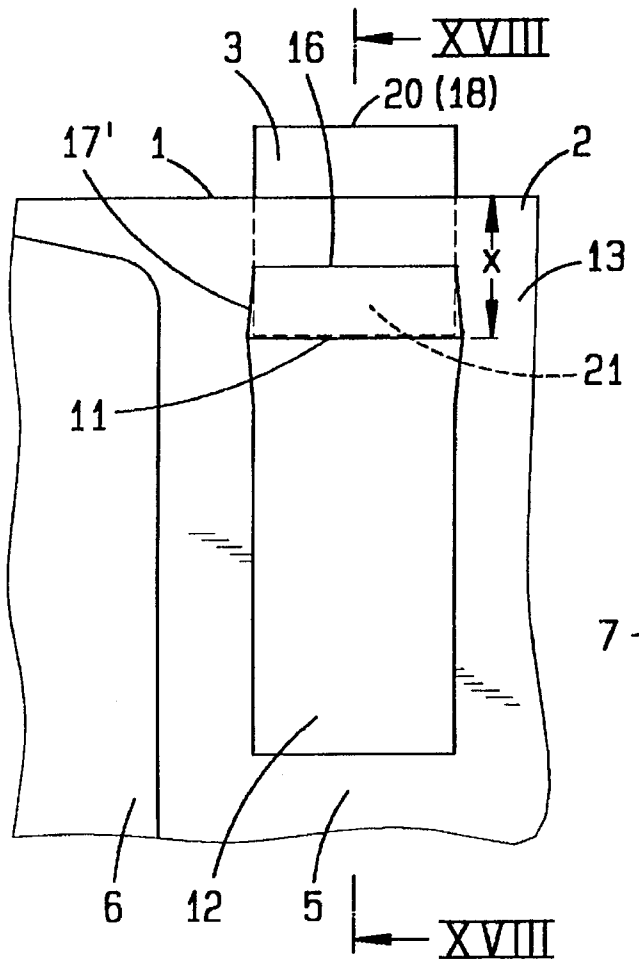
FIG. 17 shows the same for the tab in its position of use, which has a double-walled construction as a result of folding back of its free end, with tab threading on the front side.
Figure 18:
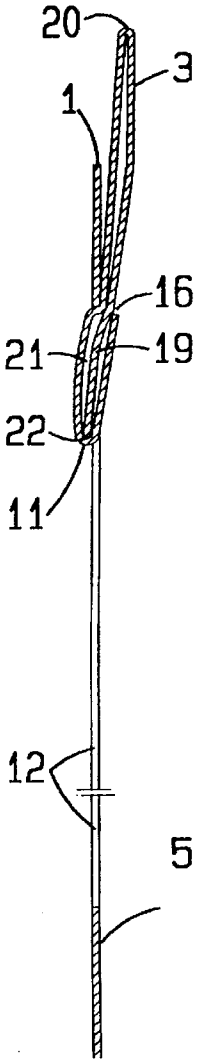
FIG. 18 shows the section on line XVIII—XVIII of FIG. 17.

FIG. 16 refers to a further embodiment, which, while retaining the basic system, provides a double layer capability for the tab 3. This leads to a construction which is in general more stable. To this end, the window 16 is simply lengthened in the direction of the lower edge 8. The doubling then takes place by the projecting region of the tab 3 being brought back by folding over or folding back of the additional cut-free section 19 about an upper edge 20. This free end of the additional fold-over section 19 is then fixed likewise by means of the push-through slit 16 of the edge strip 13, and in particular by double use of this slit. The section 19 is brought back to lie against the section forming the remainder of the tab 3. By passing twice through the above-mentioned push-through slit 16, section 19 enters into an upwardly opening pocket 21 between the edge strip 13 and the region of the tab adjacent to the fold-over edge. The base 22 of the pocket 21 formed by the inner side of the sharp fold bend of the fold edge 11 engages the free edge of the tab-forming portion in a push or insertion limiting manner. In this manner, there results a double layering of the tab which is suited to best withstand mechanical demands, and there is moreover in portions a three-layered tab region. The upper edge 20 formed by folding is defined as a groove or notch edge in the cutting out. When transformed into the position of use, this edge corresponds to the upper edge 18 of the single-layered tab 3. The initial insertion takes place from the front side of the rear wall 5.

In the case of this third embodiment also, the expedient of the converging side edges being V-shaped stages of the tab 3 is likewise used.

Figures 19, 20, 21:
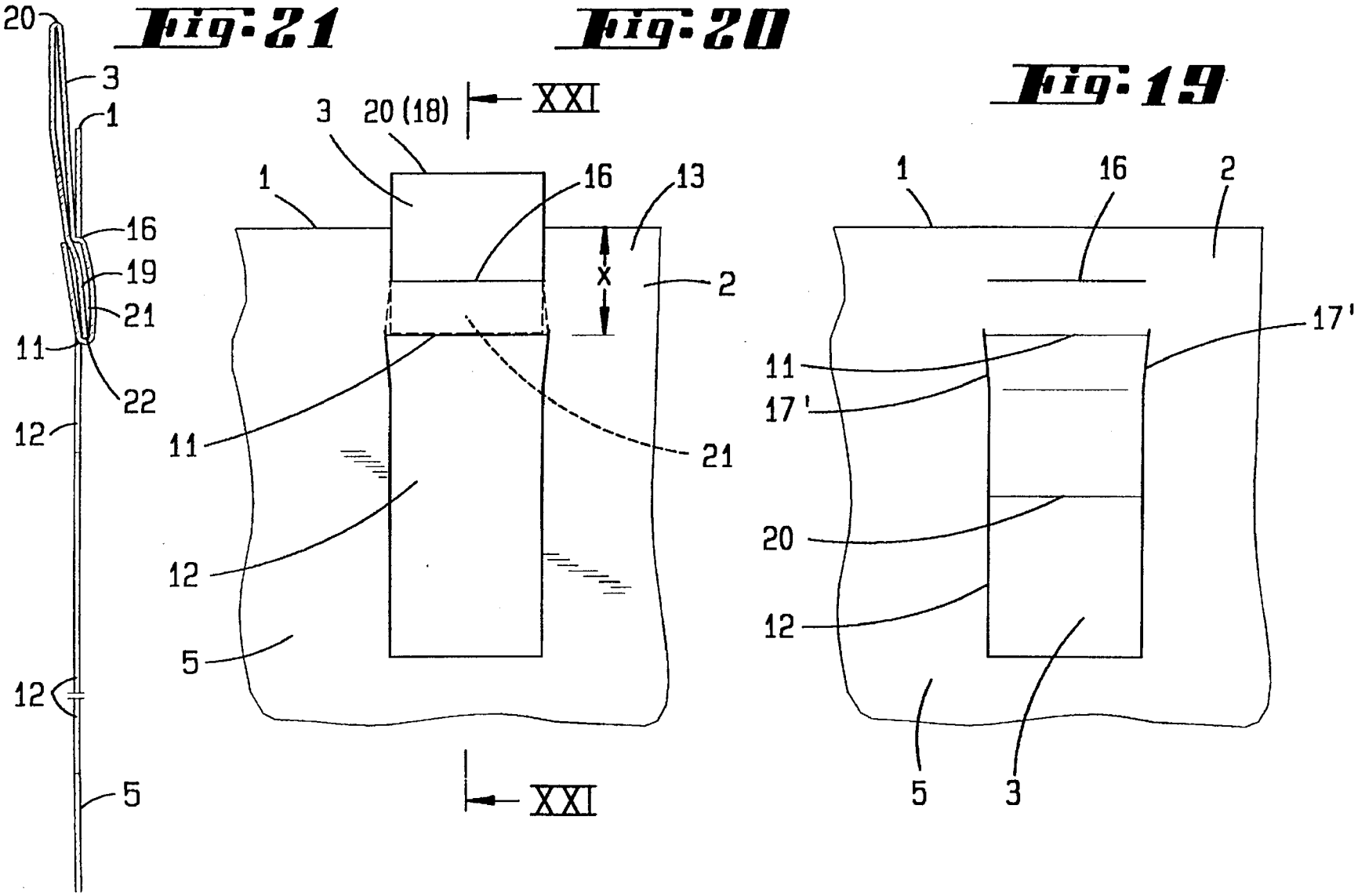
FIG. 19 shows a representation corresponding to FIG. 16 of a tab insertion arrangement proceeding from a starting point behind the rear wall.
FIG. 20 shows this after completion.
FIG. 21 shows the section on line XXI—XXI of FIG. 20.

FIG. 20 shows on the other hand, insertion of the free end of the tab from the other side, by its introduction from the rear side.

If the windowing is not effected in the record folder itself the arrangements individually identified above may be realised on a supplementary strip 23 which is associatable with the record folder. Technical details and the reference numbers adverting to them in the text are used in corresponding manner, in part without repetition in the text.

Figure 22:
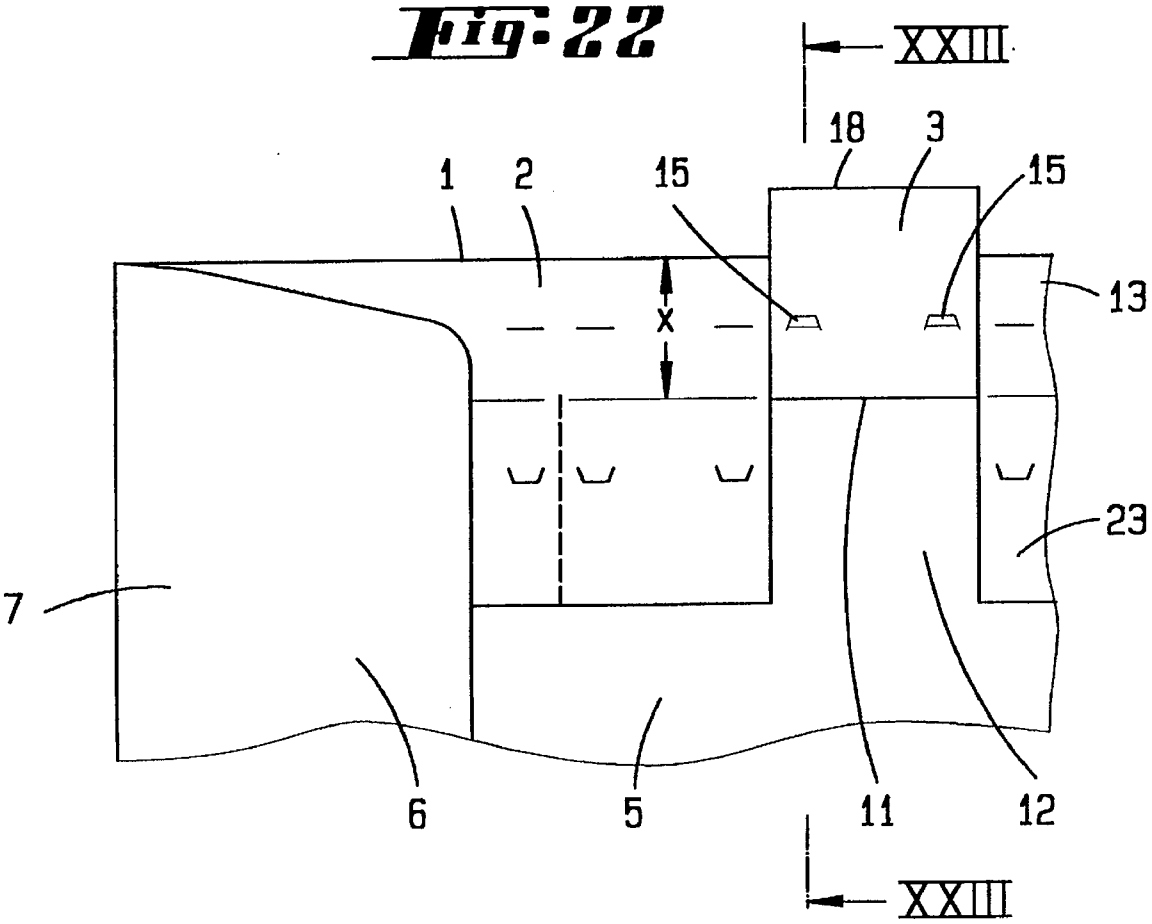
FIG. 22 shows a record folder formed according to the invention in accordance with a fourth embodiment, according to which the tab arrangement is formed by a supplementary strip, with folded-out tab and side-by-side juxtaposition of the tabs.
Figure 23:
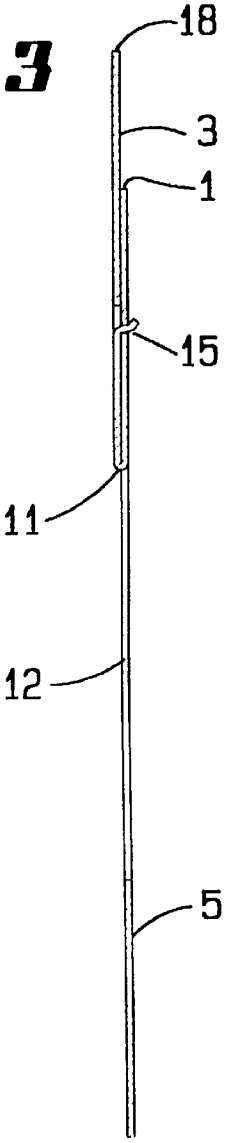
FIG. 23 shows the section on line XXIII—XXIII of FIG. 22.
Figure 24:
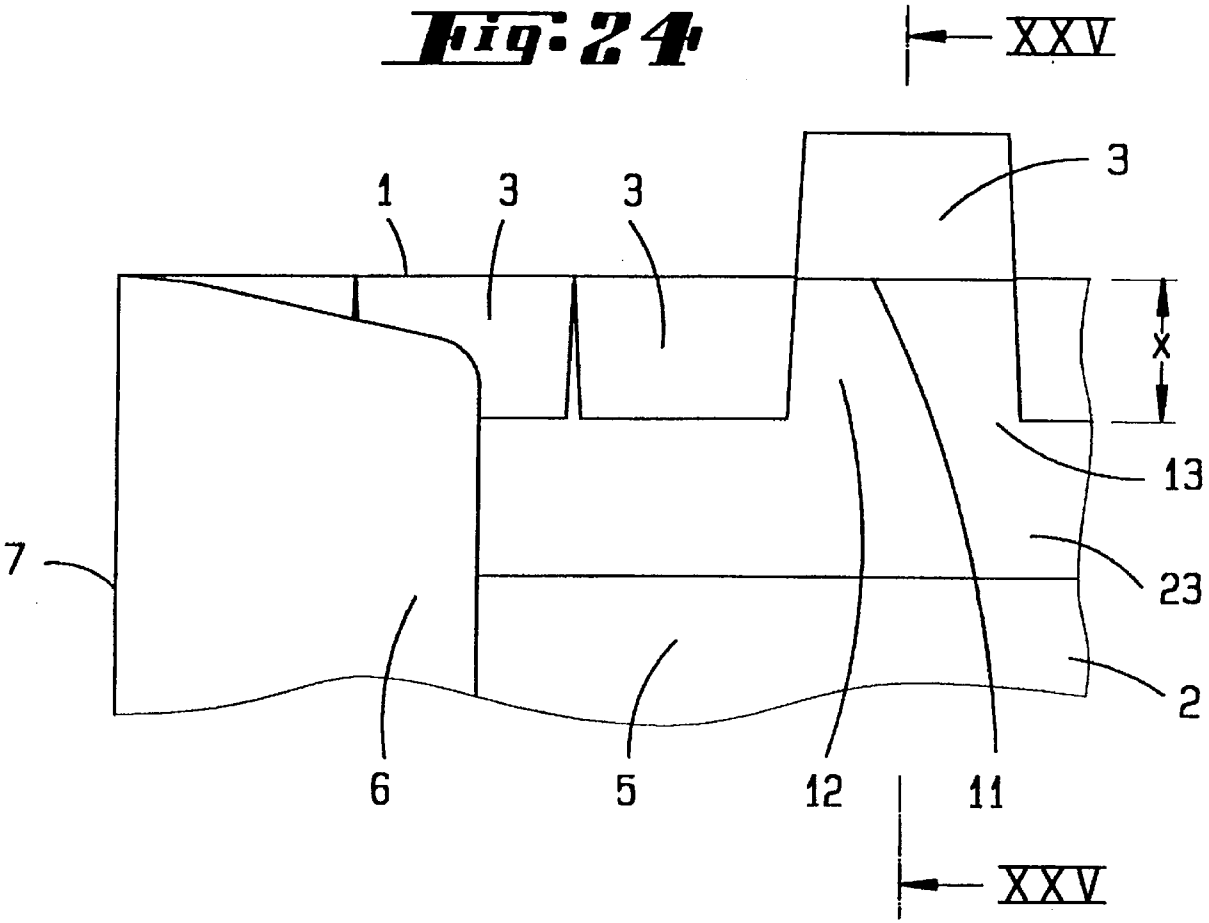
FIG. 24 shows a representation corresponding to FIG. 22 for a simplified modified embodiment of the supplementary strip.
Figure 25:
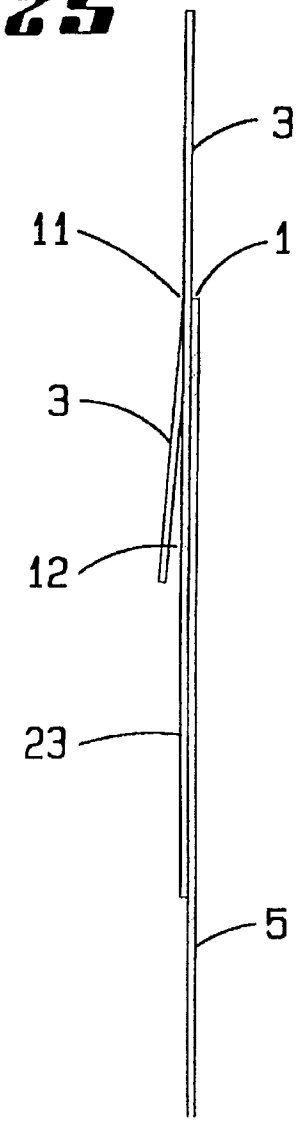
FIG. 25 shows the section on line XXV—XXV of FIG. 24.

It is apparent from FIG. 22 that the tabs 3 which may be opened out are sections of a supplementary strip 23 fixedly connected to the sheet 2, i.e. for example by gluing. The supplementary strip 23 is here located on the front face of the rear wall 5 of a record folder formed from a foldable blank and terminates at the edge 1. The same applies in regard to the variant of FIG. 24. In both cases, the width of the strip is selected for an open window 12 to be left on side located at the fold-over edge 11. The comb-form or series-form arrangement of the tabs 3 is defined either by perforation (see FIG. 22) or alternatively by means of edge-located V-shaped sections (FIG. 24). In the latter-mentioned variant, the fold edge 11 extends in alignment with the edge 1. The tab forming portions themselves are not releasably secured, or not all of them are so secured. The supplementary strip 23 may also be a fold-over section of the sheet 2.

Figure 26:
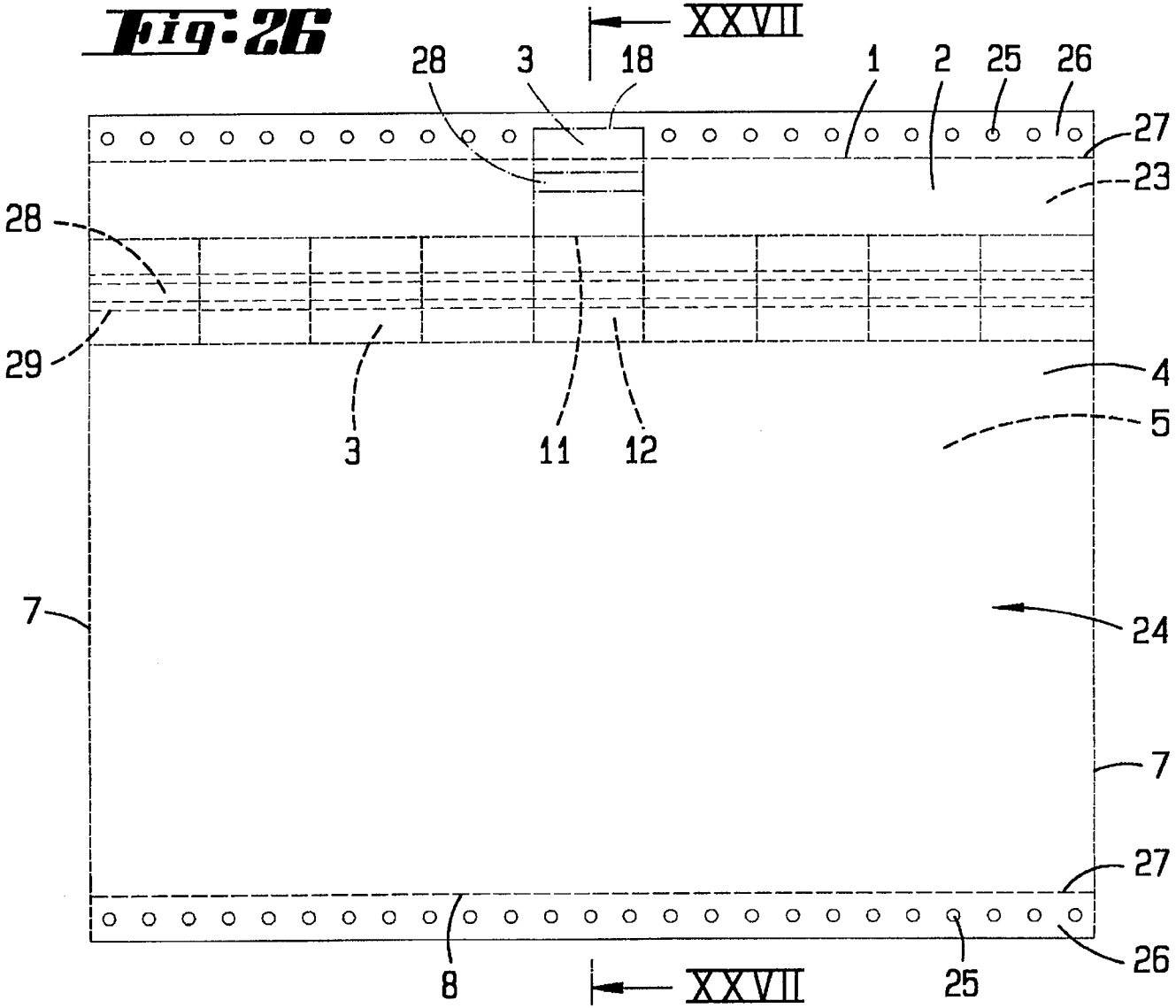
FIG. 26 shows as a fifth embodiment of the invention, a plan view onto a section of an endless web forming a file pocket with intermediately engaged supplementary strip.
Figure 27:
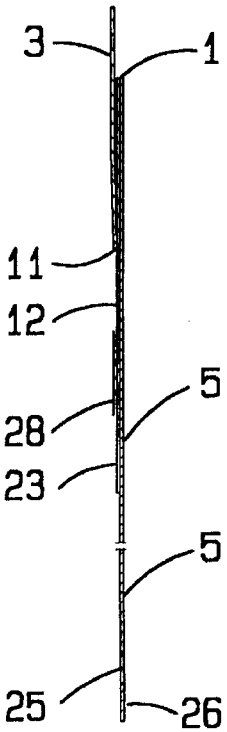
FIG. 27 shows the section on line XXVII—XXVII of FIG. 26.
Figure 29:
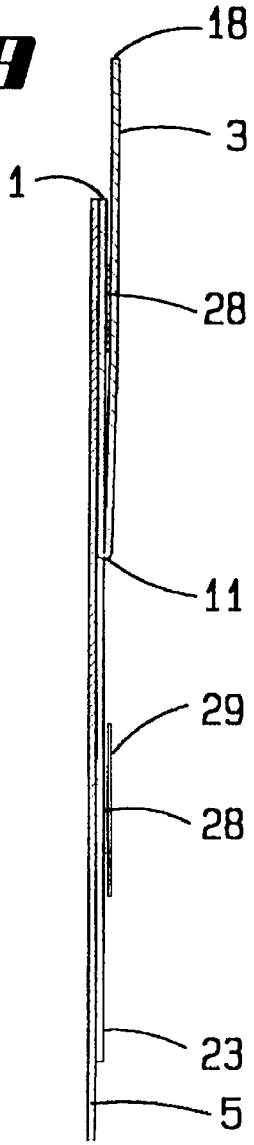
FIG. 29 is the section on the line XXIX—XXIX of FIG. 28.
Figure 28:
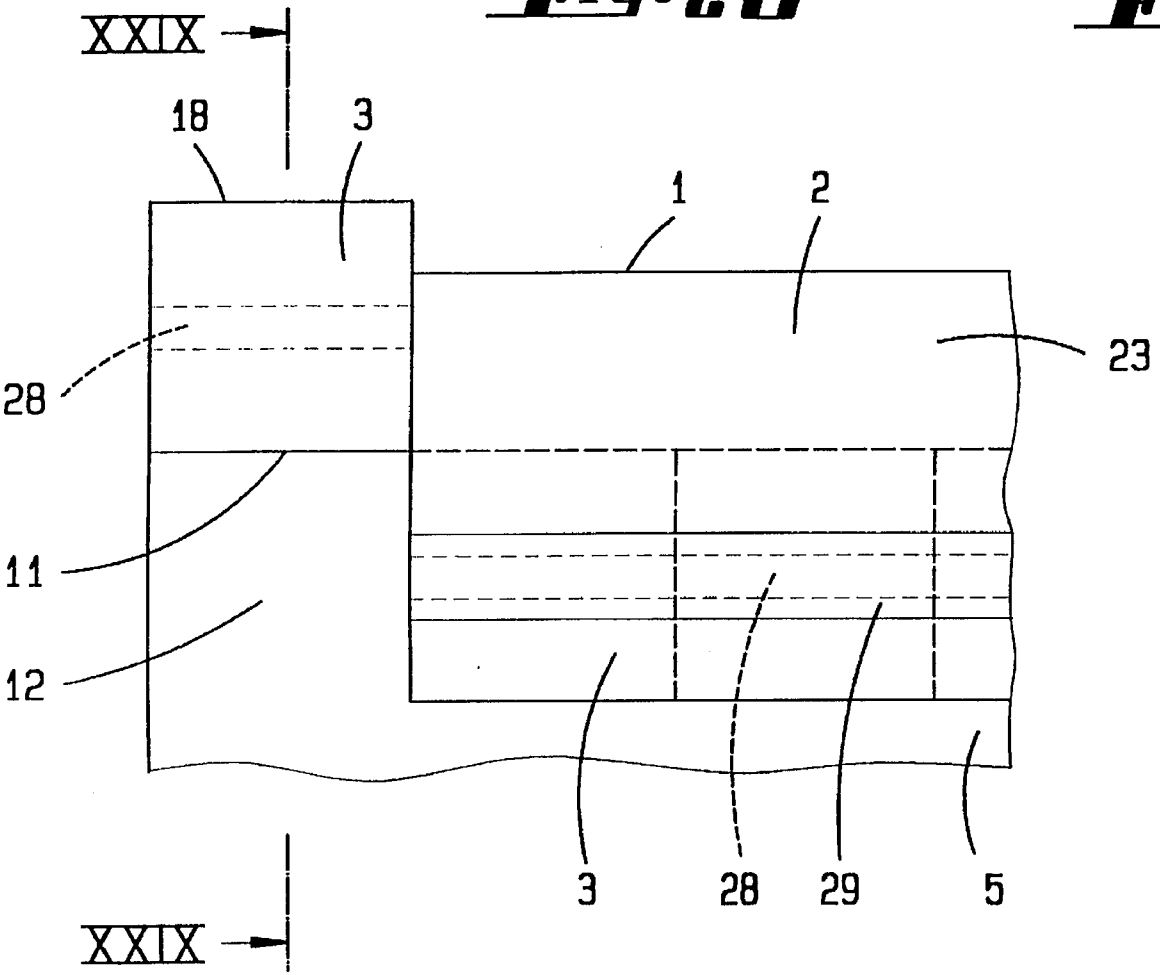
FIG. 28 shows a section of FIG. 26, enlarged, with representation of a fold-out position of the tab after removal of the perforation hole strip, so that the tab has a free projection, also in the case where the front wall is omitted.

FIG. 26 and the drawings following it embody use of the principle according to the invention in a multilayer endless web 24, in particular a double-layered web. There is in this case also an embodiment with an "open" window. The supplementary strip 23 is formed as an adhesive strip for connection to the endless web 24 and is associated in this way with the endless web 24. The two lateral apertured strips 26, which extend parallel to one another and have perforation holes 25 for pin rollers of a transport device, are connected to the endless web 24 by means of perforation lines 27. By removal of the apertured strips 26, the edge 1 of the record folder etc. is exposed. The folded over tar 3 thus enters into the projecting disposition apparent from FIGS. 26 to 28.

The supplementary strip 23 is, as shown, held between front wall 4 and rear wall 5, or it may also be externally associatable.

In order also to secure this tab 3, there is again used at least the described gluing 14.

Instead of conventional gluing, a self-adhesive connection may be employed. To this end, there extends over the back or the front surface of the tab 3 before it is folded out, a self-adhesive strip 28, which is overlaid by a protective strip 29 releasable only by action of the user. The protective strip 29 is also perforated in the transverse direction for precise release of the respective tab 3 from the series shown.

A variant of this solution is further apparent from FIG. 30. In this case, the supplementary strip 23 is however, as already indicated above, positioned in the region of a transverse edge 7 of the record folder to be formed. In this case, the supplementary strip 23 which is likewise associated by adhesive means is not co-extensively included in the assembly of the endless web 24, but is introduced in a transverse manner adjacent to each separation location.

Figures 32, 33:
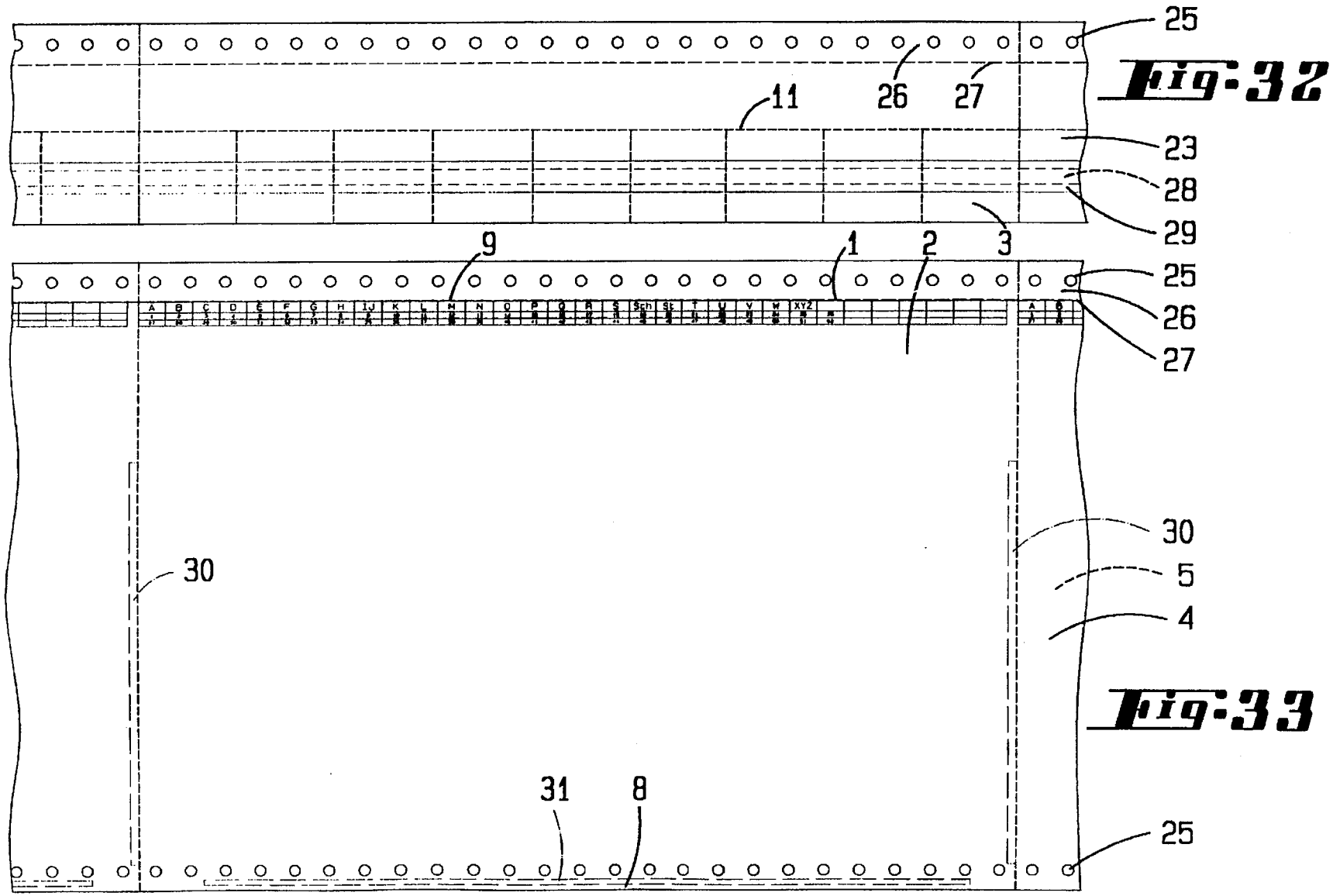
FIG. 32 is the co-extensive supplementary strip according to FIG. 26 in independent representation.
FIG. 33 is the associated endless web, also in independent representation.

Details of the pocket formation of this record folder are apparent from FIG. 33. In this case, release features 30 are provided along the transverse edge 7. Besides these release features 30 arranged transversely to the longitudinal extent of the endless web 24, there is also located another release feature in the region of the lower edge 8. This release feature is designated by reference numeral 31. The folder is thus closed in two directions at right-angles. The lower perforation holes 25 for the drive pins of a transport device are not separable.

The arrangement in regard to the tab may also be used on filing cards, separating sheets etc.

I claim:

1. Arrangement of a tab (3) projecting over an edge (1) of a base sheet (2) of record folders, index cards and the like, particularly for inscription, wherein the tab (3) is releasable up to a fold edge (11) and foldable out of a plane of the sheet (2) into a position in which said tab projects beyond said edge of the sheet, the arrangement further comprising, a supplementary strip (23) fixedly connected to the sheet (2), and said releasable tab (3) is a section of said supplementary strip.

2. Arrangement of a tab according to claim 1, wherein said sheet has an edge strip (13) having a push-through slit (16), and said tab (3) is secured by the tab extending through said push-through slit (16) of the edge strip (13).

3. Arrangement according to claim 2, wherein said tab (3) when folded over forms a window (12) in said sheet (2).

4. Arrangement according to claim 2, wherein said tab (3) further comprises a cut-free section (19) folded about an upper edge (20) of the tab (3), and wherein a free end of the fold-over section (19) is secured by extending through the push-through slit (16) of the edge strip (13).

5. Arrangement according to claim 1, wherein the supplementary strip (23) is coordinated to an endless web (24), said strip is formed with perforation holes (25) aligned with the endless web (24).

6. Arrangement according to claim 2, wherein said tab has side edges which are stepped (17) with respect to one another, and the length of the push-through slit (16) corresponds approximately to the length of an upper edge (18) of said tab.

7. Arrangement according to claim 2, wherein the length of the push-through slit (16) is less than the length of the fold edge (11) and greater than the length of an upper edge (18) of the tab.

8. Arrangement according to claim 2, wherein said tab has side edges which extend in a converging manner (17'), and the length of the push-through slit (16) corresponds approximately to the length of an upper edge (18) of said tab.

* * * * *